US008766850B2

(12) United States Patent
Park et al.

(10) Patent No.: US 8,766,850 B2
(45) Date of Patent: Jul. 1, 2014

(54) METHOD AND APPARATUS FOR ADJUSTING HORIZONTAL BEAM OF OMNI-DIRECTIONS ANTENNA

(75) Inventors: Ju Derk Park, Daejeon (KR); Sang Gi Hong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 258 days.

(21) Appl. No.: 13/269,184

(22) Filed: Oct. 7, 2011

(65) Prior Publication Data

US 2012/0086603 A1 Apr. 12, 2012

(30) Foreign Application Priority Data

Oct. 7, 2010 (KR) ..... 10-2010-0097706
May 20, 2011 (KR) ..... 10-2011-0048056

(51) Int. Cl.
*H01Q 3/00* (2006.01)

(52) U.S. Cl.
USPC ..... 342/359

(58) Field of Classification Search
USPC ..... 342/359
See application file for complete search history.

(56) References Cited

U.S. PATENT DOCUMENTS 5,905,473 A * 5/1999 Taenzer ..... 343/834
2005/0024256 A1* 2/2005 Ridderheim et al. ..... 342/29
2010/0233973 A1 9/2010 Churan
2011/0151932 A1* 6/2011 Kim ..... 455/562.1
2012/0039166 A1* 2/2012 Gao ..... 370/221

FOREIGN PATENT DOCUMENTS

KR 10-1055127 8/2011

* cited by examiner

*Primary Examiner* — Harry Liu
(74) *Attorney, Agent, or Firm* — Nelson Mullins Riley & Scarborough LLP; Anthony A. Laurentano, Esq.; Dipti Ramnarain, Esq.

(57) ABSTRACT

A horizontal beam adjusting method and apparatus for an omni-directional antenna are provided. The horizontal beam adjusting apparatus may generate a switch control signal according to an inclination of the omni-directional antenna, and adjust a radiation direction of the omni-directional antenna according to the switch control signal. Accordingly, the adjusted radiation direction may have horizontal omni-directionality with respect to a ground surface.

18 Claims, 9 Drawing Sheets

METHOD AND APPARATUS FOR ADJUSTING HORIZONTAL BEAM OF OMNI-DIRECTIONS ANTENNA

CROSS-REFERENCE TO RELATED APPLICATIONS

This application claims the benefit of Korean Patent Application No. 10-2010-0097706 and of Korean Patent Application No. 10-2011-0048056, respectively filed on Oct. 7, 2010 and May 20, 2011, in the Korean Intellectual Property Office, the disclosures of which are incorporated herein by reference.

BACKGROUND

1. Field of the Invention

The present invention relates to a technology for controlling a radiation direction of an omni-directional antenna attached to a terminal configuring a mobile communication network, wireless communication network, or sensor network.

2. Description of the Related Art

Generally, a terminal used for mobile communication, wireless communication, and a sensor network uses a small omni-directional antenna to perform the communication. The omni-directional antenna is capable of radiating radio waves with a constant intensity in all directions along a horizontal plane. The omni-directional antenna has a characteristic of radiating radio waves within a specific beam width when installed vertically to a ground surface. Therefore, when the omni-directional antenna or a terminal including the omni-directional antenna is not vertical to the ground surface, the radiation direction of the omni-directional antenna may lose omni-directionality.

FIG. 1 illustrates a diagram showing a radiation pattern of an omni-directional antenna 102 installed vertically to a ground surface according to a related art.

According to FIG. 1, the omni-directional antenna 102 may be attached to a terminal 101. Here, the terminal 101 may be installed on a ground surface 103. That is, the omni-directional antenna 102 may form a right angle with respect to the ground surface 103. Accordingly, a radiation direction 104 of the omni-directional antenna may be horizontal to the ground surface 103. When the radiation direction 104 is formed to be horizontal to the ground surface 103, the omni-directional antenna 102 may radiate radio waves with a constant intensity along the ground surface 103, thereby achieving omni-directionality.

FIG. 2 illustrates a diagram showing a radiation pattern of an omni-directional antenna 202 installed on an inclined surface 201 according to a related art.

According to FIG. 2, the terminal attached with the omni-directional antenna 202 may be installed on the inclined surface 201. Accordingly, a radiation direction 203 of the omni-directional antenna 202 may be sloped with respect to the ground surface 204.

When the radiation direction of the omni-directional antenna is inclined, an amount wave gain in the horizontal direction may be reduced while a number of reflected waves may be increased by the ground surface. Consequently, the omni-directionality of the omni-directional antenna may be reduced, thereby reducing the performance of the omni-directional antenna.

Accordingly, there is a desire for a new scheme for minimizing reduction of the performance of the omni-directional antenna even though the omni-directional antenna is installed on an inclined surface.

SUMMARY

An aspect of the present invention provides a technology for minimizing reduction of the performance of the omni-directional antenna, by adjusting a radiation direction of the omni-directional antenna based on an inclination of the omni-directional antenna, calculated with respect to a ground surface.

Another aspect of the present invention provides a technology for improving a communication function by configuring an omni-directional antenna such that a radiation direction is horizontally omni-directional with respect to a ground surface.

According to an aspect of the present invention, there is provided a horizontal beam adjusting method including generating a switch control signal based on an inclination of an antenna, and adjusting a radiation direction of the antenna according to the switch control signal.

The adjusting of the radiation direction may include short-circuiting or opening at least one switch according to the switch control signal, and adjusting the radiation direction of the antenna to be inclined toward the at least one short-circuited switch.

The generating of the switch control signal may include determining whether to short-circuit or open the switch using an inclination of the antenna and a predetermined threshold value, and generating the switch control signal containing at least one of a short-circuiting signal and an opening signal based on the determination.

The generating of the switch control signal may include obtaining a gravity value of each axis using a tilt sensor, and calculating the inclination of the antenna using the obtained gravity value of each axis.

According to another aspect of the present invention, there is provided a horizontal beam adjusting apparatus including a control signal generation unit to generate a switch control signal based on an inclination of an antenna, and an adjusting unit to adjust a radiation direction of the antenna according to the switch control signal.

The adjusting unit may include a parasitic element to adjust the radiation direction of the antenna through coupling with a radiator, a switch to connect the parasitic element to a grounding unit according to the switch control signal, and an impedance matching unit to adjust an impedance value between the parasitic element and the grounding unit.

The switch may be disposed between the parasitic element and the grounding unit.

The impedance matching unit may be disposed between the parasitic element and the grounding unit.

The impedance matching unit may be disposed between the switch and the grounding unit. Here, one end of the switch may be connected with the impedance matching unit whereas the other end is connected to the parasitic element.

The switch may be disposed between the impedance matching unit and the grounding unit. Here, one end of the switch may be connected with the impedance matching unit whereas the other end is connected to the grounding unit.

The horizontal beam adjusting apparatus may further include a tilt sensor to calculate an inclination of the antenna with respect to a ground surface.

EFFECT

According to embodiments of the present invention, reduction of the performance of the omni-directional antenna may be minimized since a radiation direction of the omni-directional antenna is adjusted based on an inclination of the omni-directional antenna, the inclination calculated with respect to a ground surface.

Additionally, according to embodiments of the present invention, communication function may be improved by configuring an omni-directional antenna to have a horizontally omni-directional radiation direction with respect to a ground surface.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
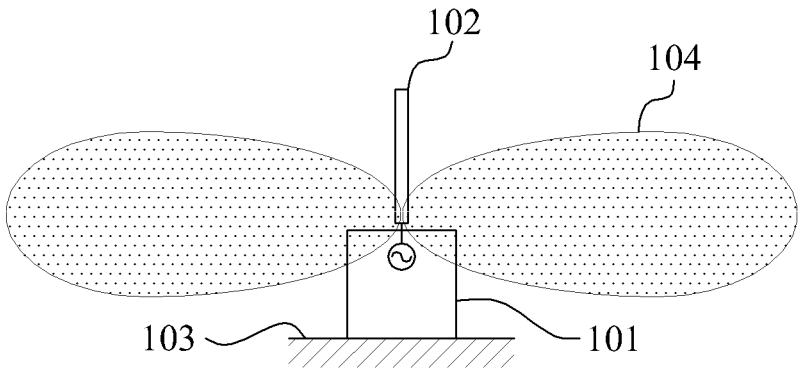
FIG. 1 (RELATED ART)
FIG. 1 is a diagram illustrating a radiation pattern of an omni-directional antenna installed vertically to a ground surface according to a related art.
Figure 2:
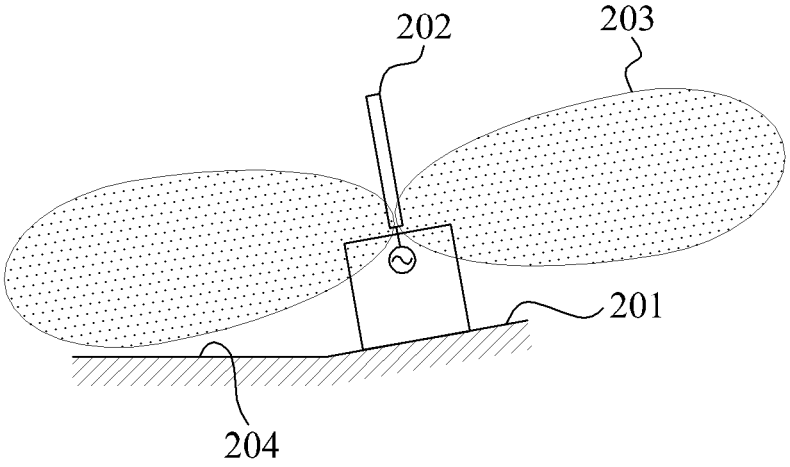
FIG. 2 (RELATED ART)
FIG. 2 is a diagram illustrating a radiation pattern of an omni-directional antenna installed on an inclined surface according to a related art.

Reference will now be made in detail to exemplary embodiments of the present invention, examples of which are illustrated in the accompanying drawings. While specific terms were used, they were not used to limit the meaning or the scope of the present invention described in the claims. Therefore, the terms are to be interpreted corresponding to the technical concept of the present invention, based on the inventor being capable of properly defining the terms to explain the present invention in the best manner.

Accordingly, embodiments and structures illustrated herein are suggested only by way of example but do not represent all technical concepts of the present invention. Therefore, it will be understood that various equivalents and modifications may exist which can replace the embodiments described at the time of the application. In addition, like reference numerals refer to the like elements throughout the drawings.

Figure 3:
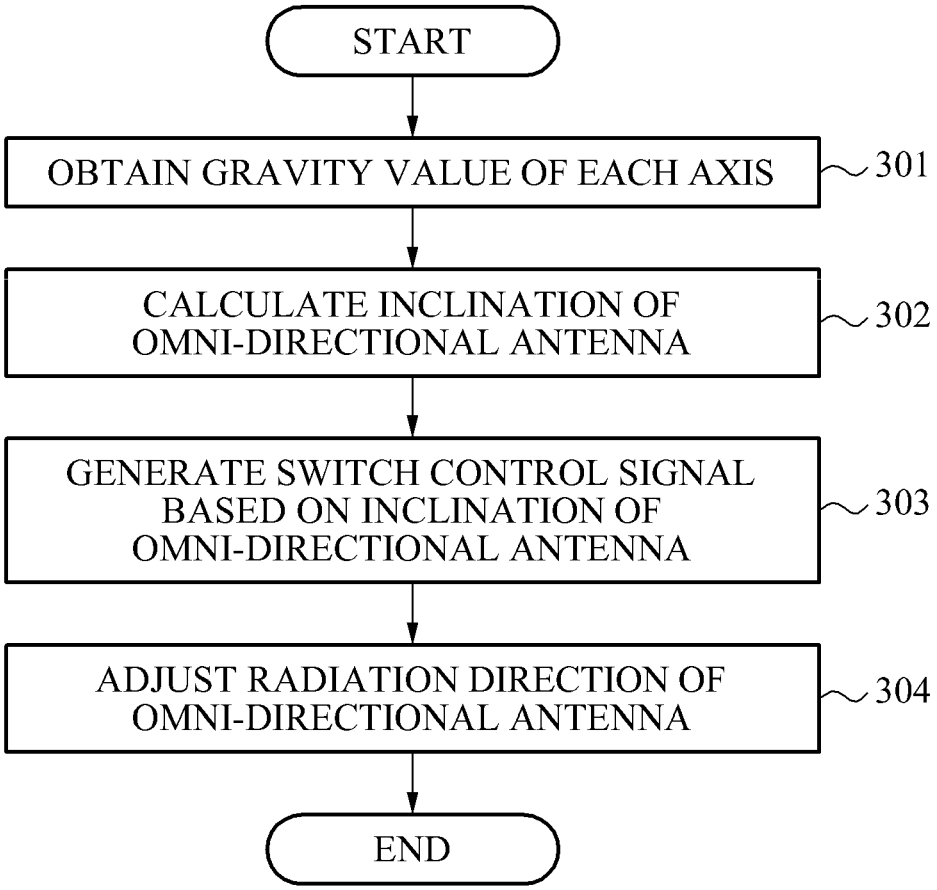
FIG. 3 is a flowchart illustrating a horizontal beam adjusting method for an omni-directional antenna according to an embodiment of the present invention.

FIG. 3 is a flowchart illustrating a horizontal beam adjusting method for an omni-directional antenna according to an embodiment of the present invention. In FIG. 3, the horizontal beam adjusting method may be performed by a horizontal beam adjusting apparatus. For example, a mobile communication terminal, a sensor node, a short range device, and the like may be applied to the horizontal beam adjusting apparatus.

First, after the horizontal beam adjusting apparatus attached with the omni-directional antenna is installed on an inclined surface or a ground surface, the horizontal beam adjusting apparatus may initialize a tilt sensor. At this time, variables used for calculating an inclination of the omni-directional antenna may be initialized.

Therefore, in operation 301, the tilt sensor may obtain a gravity value of each axis. Here, the tilt sensor may be attached to the omni-directional antenna, and the omni-directional antenna may be attached to the horizontal beam adjusting apparatus. Here, a tilt sensor including at least two axes may be attached to the omni-directional antenna. For example, the tilt sensor may include at least one of the tilt sensor including at least two axes, and a gravity sensor including at least two axes.

Next, in operation 302, the tilt sensor may calculate the inclination of the omni-directional antenna using the gravity value of each axis.

For example, when the horizontal beam adjusting apparatus with the omni-directional antenna is installed on the inclined surface, the tilt sensor may calculate the inclination of the omni-directional antenna with respect to the ground surface, using the gravity value of each axis.

In operation 303, the horizontal beam adjusting apparatus may generate a switch control signal based on the inclination of the omni-directional antenna. Here, the horizontal beam adjusting apparatus may determine whether to short-circuit or open a switch using the inclination of the omni-directional antenna and a predetermined threshold value. Additionally, based on the determination result, the horizontal beam adjusting apparatus may generate the switch control signal containing at least one of a short-circuiting signal and an opening signal.

Next, in operation 304, the horizontal beam adjusting apparatus may adjust a radiation direction of the omni-directional antenna by short-circuiting or opening at least one switch according to the switch control signal. Here, the radiation direction may be adjusted to be inclined toward the short-circuited switch.

Figure 4:
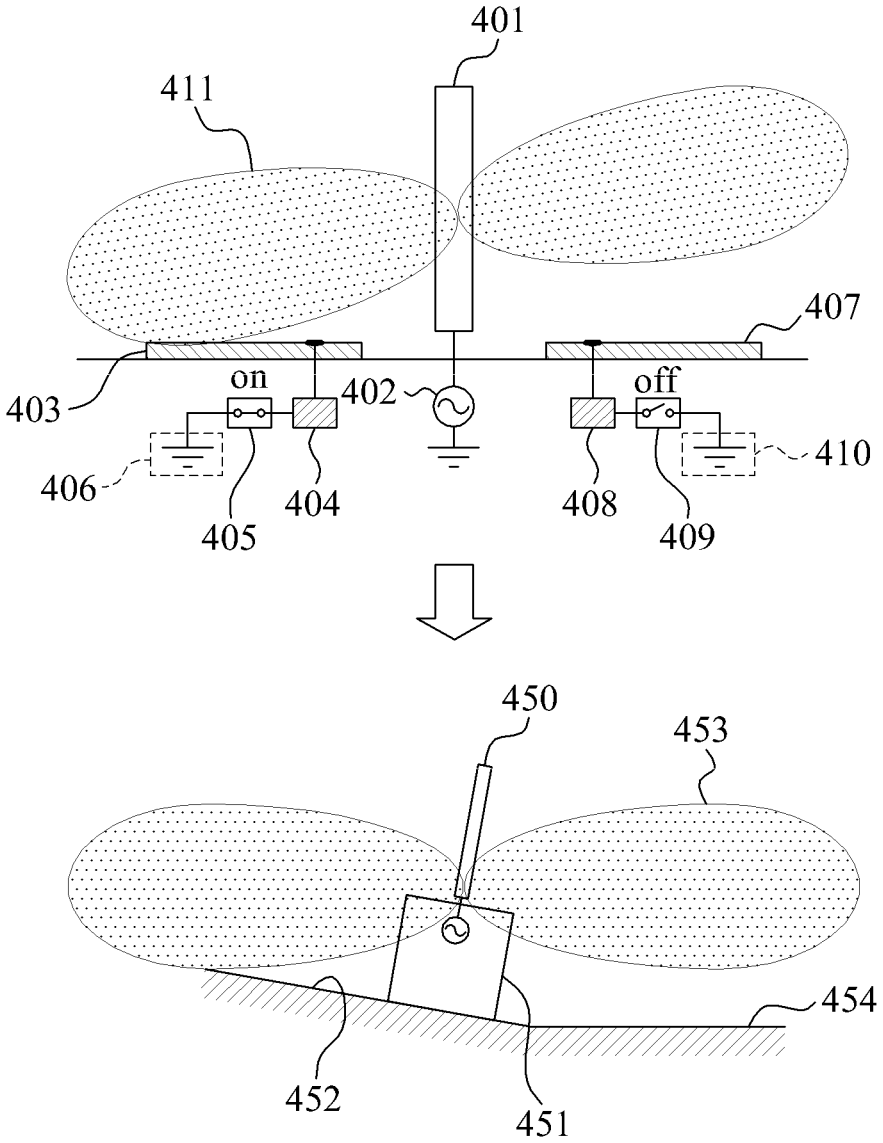
FIG. 4 is a diagram illustrating a radiation direction adjusting method for an omni-directional antenna installed on a rightward inclined surface, according to an embodiment of the present invention.

FIG. 4 is a diagram illustrating a radiation direction adjusting method for an omni-directional antenna 450 installed on a rightward inclined surface 452, according to an embodiment of the present invention.

According to FIG. 4, when a horizontal beam adjusting apparatus 451 attached with the omni-directional antenna 450 is installed on the rightward inclined surface 452, a tilt sensor mounted to the omni-directional antenna 450 may calculate an inclination of the horizontal beam 450.

Here, the omni-directional antenna 450 includes a pair of parasitic elements 403 and 407, a pair of impedance impedance matching units 404 and 408, a pair of switches 405 and 409, and a pair of grounding units 406 and 410, with respect to a radiator 401. Therefore, the horizontal beam adjusting apparatus 451 may be able to determine whether to short-circuit or open the respective switches 405 and 409 using the inclination of the omni-directional antenna and a predetermined threshold value.

For example, when the inclination of the omni-directional antenna 450 is greater than or equal to the threshold value, the horizontal beam adjusting apparatus 451 may determine that the omni-directional antenna 450 is installed on the inclined surface. That is, the horizontal beam adjusting apparatus 451 may determine that the radiation direction is inclined and needs to be adjusted. When the inclined surface is inclined rightward, the horizontal beam adjusting apparatus 451 may short-circuit a first switch 405 disposed on the left of the radiator 401 while opening a second switch 409 disposed on the right of the radiator 401.

Additionally, the horizontal beam adjusting apparatus 451 may generate a switch control signal containing a short-circuiting signal for the first switch 405 and an opening signal for the second switch 409. Therefore, the horizontal beam adjusting apparatus may short-circuit the first switch 405 according to the switch control signal, thereby connecting a first parasitic element 403 and a first impedance matching unit 404 to a first grounding unit 406. Here, as the first switch 405 is short-circuited, coupling between the radiator 401 and the first parasitic element 403 may be enhanced. Thus, the horizontal beam adjusting apparatus may adjust a radiation direction 411 of the omni-directional antenna to be inclined to the short-circuited first switch 405 between the first switch 405 and the second switch 409. Specifically, the horizontal beam adjusting apparatus may adjust the radiation direction 411 of the omni-directional antenna to be a radiation direction 453 inclined toward the inclined surface 452. According to this, the adjusted radiation direction 453 may have omni-directionality in a horizontal direction with respect to a ground surface 454.

Figure 5:
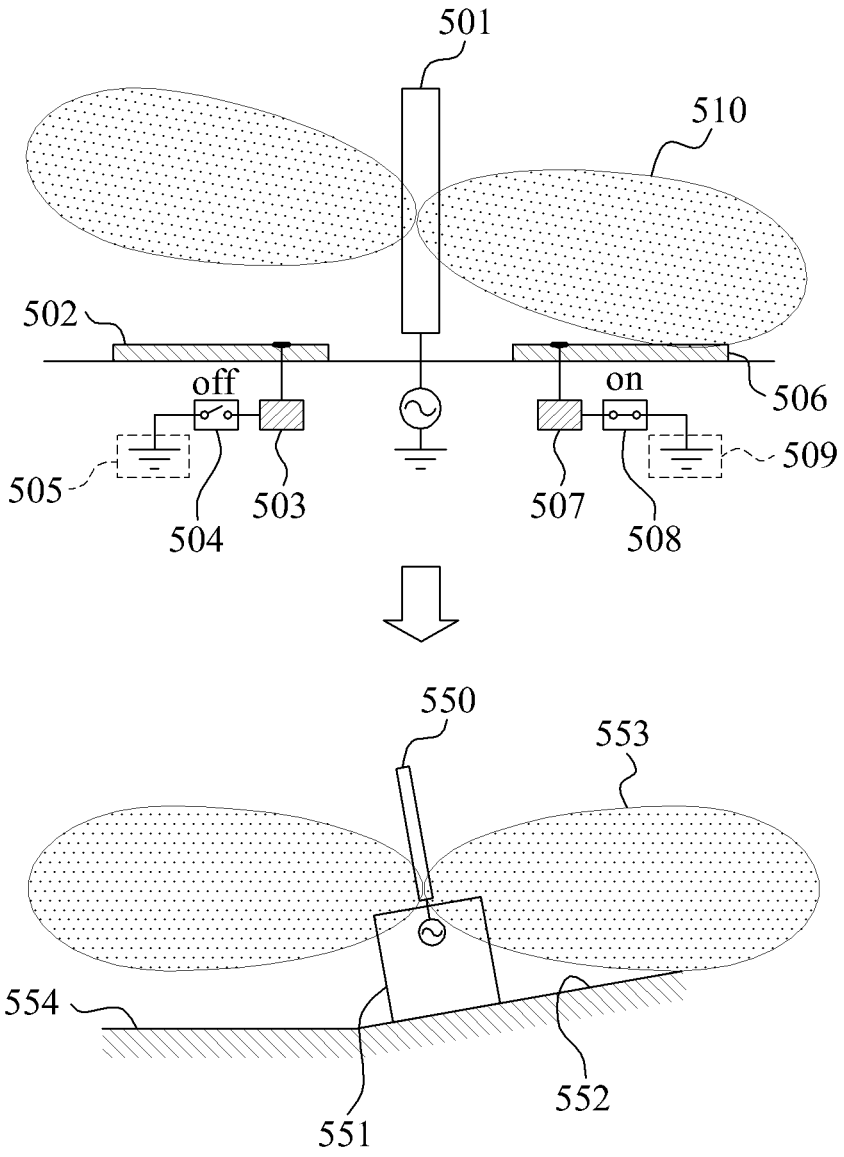
FIG. 5 is a diagram illustrating a radiation direction adjusting method for an omni-directional antenna installed on a leftward inclined surface, according to an embodiment of the present invention.

FIG. 5 is a diagram illustrating a radiation direction adjusting method for an omni-directional antenna 550 installed on a leftward inclined surface, according to an embodiment of the present invention.

According to FIG. 5, when a horizontal beam adjusting apparatus 551 attached with the omni-directional antenna 550 is installed on an inclined surface 552 inclined leftward, a tilt sensor mounted to the omni-directional antenna 550 may calculate a inclination of the omni-directional antenna 550.

Here, the omni-directional antenna 550 includes a pair of parasitic elements 502 and 506, a pair of impedance matching units 503 and 507, a pair of switches 504 and 508, and a pair of grounding units 505 and 509, with respect to a radiator 501. Therefore, the horizontal beam adjusting apparatus 551 may determine whether to short-circuit or open the respective switches 504 and 508 using the inclination of the omni-directional antenna 550 and a predetermined threshold value.

For example, when the inclination of the omni-directional antenna 550 is greater than or equal to the threshold value, the horizontal beam adjusting apparatus 551 may determine that the omni-directional antenna 550 is installed on the inclined surface. That is, the horizontal beam adjusting apparatus 551 may determine that the radiation direction needs to be adjusted. When the inclined surface is inclined leftward, the horizontal beam adjusting apparatus 551 may short-circuit a second switch 508 disposed on the right of the radiator 501 while opening a first switch 504 disposed on the left of the radiator 501.

Additionally, the horizontal beam adjusting apparatus 551 may generate a switch control signal containing a short-circuiting signal for the second switch 508 and an opening signal for the first switch 504. Therefore, the horizontal beam adjusting apparatus 551 may short-circuit the second switch 508 according to the switch control signal, thereby connecting a second parasitic element 506 and a second impedance matching unit 507 to a second grounding unit 509. Here, as the second switch 508 is short-circuited, coupling between the radiator 501 and the second parasitic element 506 may be enhanced. Thus, the horizontal beam adjusting apparatus 551 may adjust a radiation direction 510 of the omni-directional antenna 550 to be inclined to the short-circuited second switch 508 out of the first switch 504 and the second switch 508. Specifically, the horizontal beam adjusting apparatus 551 may adjust the radiation direction 510 of the omni-directional antenna 550 to be a radiation direction 553 inclined toward the inclined surface 552. According to this, the adjusted radiation direction 553 may have omni-directionality in a horizontal direction with respect to a ground surface 554.

Figure 6:
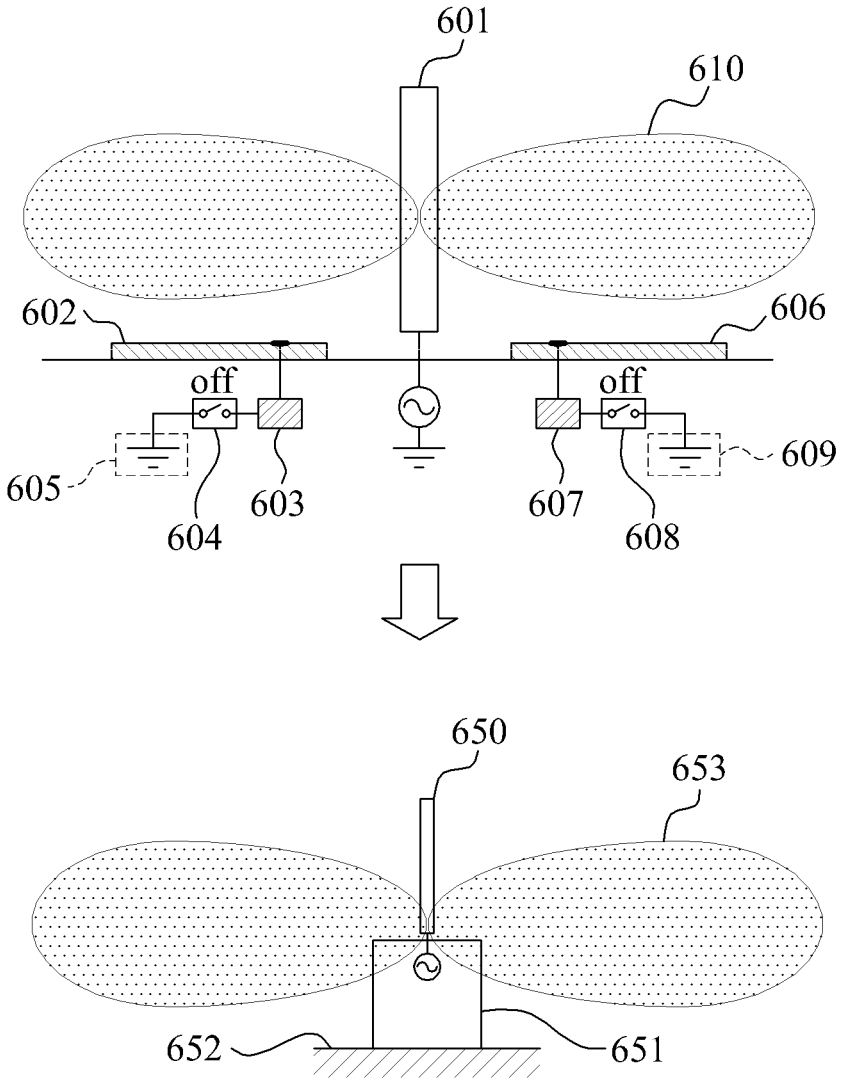
FIG. 6 is a diagram illustrating a radiation direction adjusting method for an omni-directional antenna installed on a ground surface, according to an embodiment of the present invention.

FIG. 6 is a diagram illustrating a radiation direction adjusting method for an omni-directional antenna 650 installed on a ground surface 652, according to an embodiment of the present invention.

According to FIG. 6, when a horizontal beam adjusting apparatus 651 attached with the omni-directional antenna 650 is installed on the ground surface 652, a tilt sensor mounted to the omni-directional antenna 650 may calculate an inclination of the omni-directional antenna 650. That is, the omni-directional antenna 650 may be perpendicular to the ground surface 652.

Here, the omni-directional antenna 650 includes a pair of parasitic elements 602 and 606, a pair of impedance matching units 603 and 607, a pair of switches 604 and 608, and a pair of grounding units 605 and 609, with respect to a radiator 601. Therefore, the horizontal beam adjusting apparatus 651 may determine whether to short-circuit or open the respective switches using the inclination of the omni-directional antenna 650 and a predetermined threshold value.

For example, when the inclination of the omni-directional antenna 650 is less than the threshold value since the omni-directional antenna 650 is perpendicular to the ground surface 652, the horizontal beam adjusting apparatus 651 may determine that the omni-directional antenna 650 is installed on the ground surface which is horizontal. Accordingly, the horizontal beam adjusting apparatus 651 may determine to open both a first switch 604 disposed on the left of the radiator 601 and a second switch 608 disposed on the right of the radiator 601.

Additionally, the horizontal beam adjusting apparatus 651 may generate a switch control signal containing an opening signal for the first switch 604 and an opening signal for the second switch 608. Therefore, the horizontal beam adjusting apparatus 651 may open both the first switch 604 and the second switch 608 according to the switch control signal. According to this, the horizontal beam adjusting apparatus 651 may not adjust a radiation direction 653 of the omni-directional antenna 650. That is, when the omni-directional antenna 650 is perpendicular to the ground surface 652, the radiation direction 653 has horizontal omni-directionality with respect to the ground surface 652. In this case, adjustment of the radiation direction 653 may not be performed.

In the abovementioned embodiments shown in FIGS. 4 to 6, the switches and the impedance matching units are disposed between the parasitic elements and the grounding units. One end of each switch is connected to the impedance matching unit whereas the other end is connected to the grounding unit. One end of each impedance matching unit is connected to the parasitic element while the other end is connected to the switch. That is, the parasitic element, the impedance matching unit, the switch, and the grounding unit are connected in the foregoing order.

Here, positions of the switch and the impedance matching unit may be exchanged. That is, the parasitic element, the switch, the impedance matching unit, and the grounding unit may be connected in the foregoing order. In this case, one end of the switch is connected to the parasitic element while the other end is connected to the impedance matching unit. One end of the impedance matching unit is connected to the switch while the other end is connected to the grounding unit. Since the switch and the impedance matching unit are disposed between the parasitic element and the grounding unit, the horizontal beam adjusting apparatus may adjust the radiation direction of the omni-directional antenna by short-circuiting or opening the switch.

Figure 7:
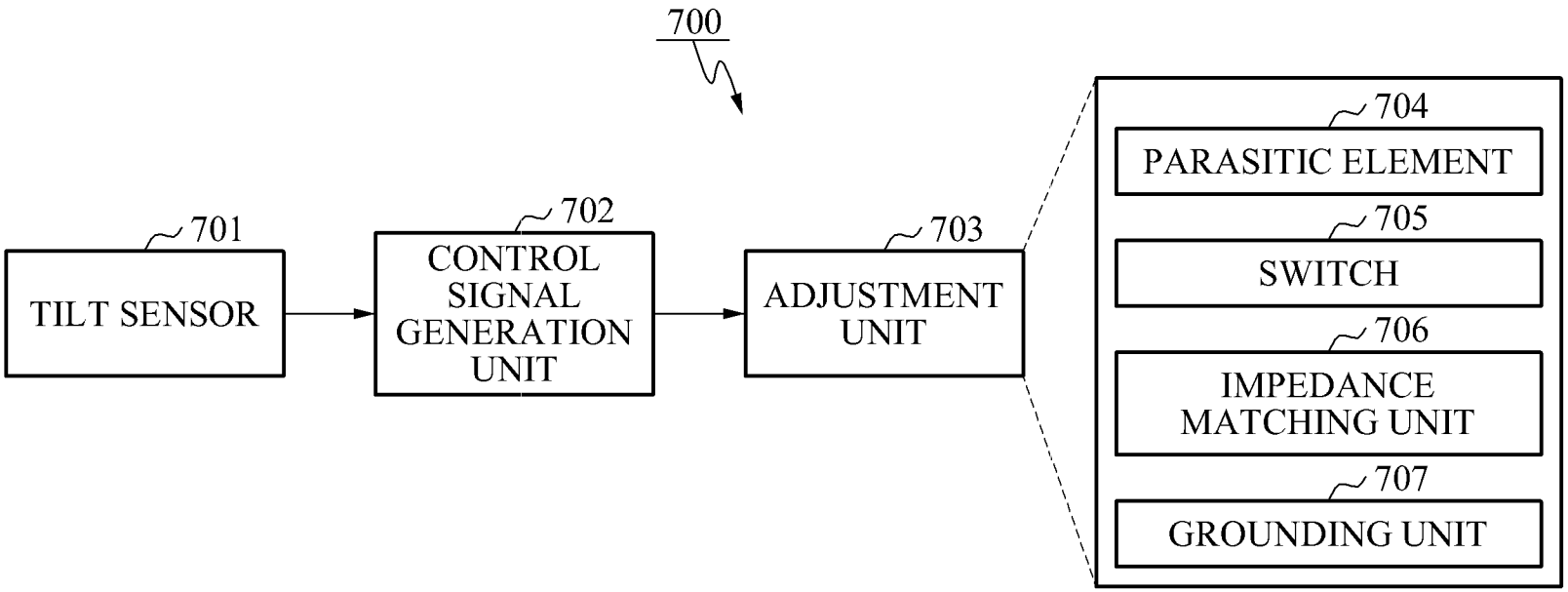
FIG. 7 is a block diagram illustrating a detailed structure of a horizontal beam adjusting apparatus according to an embodiment of the present invention.

FIG. 7 is a block diagram illustrating a detailed structure of a horizontal beam adjusting apparatus 700 according to an embodiment of the present invention.

According to FIG. 7, the horizontal beam adjusting apparatus 700 includes a tilt sensor 701, a control signal generation unit 702, and an adjusting unit 703.

The tilt sensor 701 may calculate an inclination of the omni-directional antenna by obtaining a gravity value of each axis. The tilt sensor 701 may calculate the inclination with reference to a ground surface. For example, an acceleration sensor including at least two axes and a gravity sensor including at least two axes may be used as the tilt sensor 701.

The control signal generation unit 702 may generate a switch control signal based on the inclination of the omni-directional antenna. Here, the control signal generation unit 702 may determine whether to short-circuit or open respective switches using a predetermined threshold value of the inclination. In addition, based on the determination result, the control signal generation unit 702 may generate the switch control signal containing at least one of a short-circuiting signal and an opening signal.

For example, in a state where the omni-directional antenna is installed on a leftward inclined surface, a first switch is disposed on the left of a radiator, a second switch is disposed on the right of the radiator, and the inclination of the omni-directional antenna is greater than or equal to than the predetermined threshold value, the control signal generation unit 702 may generate the switch control signal containing an opening signal for the first switch and a short-circuiting signal for the second switch.

Therefore, the adjusting unit 703 may adjust a radiation direction of the omni-directional antenna according to the switch control signal. Here, the adjusting unit 703 may adjust the radiation direction to be inclined to at least one short-circuited switch. As a result, the adjusted radiation direction of the omni-directional antenna may become omni-directional in a horizontal direction with respect to the ground surface.

For example, the adjusting unit 703 may short-circuit a switch 705 according to the switch control signal. As the switch 705 is short-circuited, an impedance matching unit 706 and a parasitic element 704 may be connected to a grounding unit 707. Accordingly, coupling between the parasitic element 704 and the radiator may be enhanced. Consequently, the radiation direction may be adjusted to be inclined toward the short-circuited switch. That is, the adjusting unit 703 may adjust the radiation direction to be inclined toward an inclined surface. Therefore, the adjusted radiation direction of the omni-directional antenna may become horizontally omni-directional with respect to the ground surface.

As above-described, the switch 705 may be short-circuited according to the switch control signal, thereby connecting the parasitic element 704 to the grounding unit 707. Accordingly, the parasitic element 704 may couple with the radiator, thereby adjusting the radiation direction of the omni-directional antenna. Here, the impedance matching unit 706 may adjust an impedance value between the parasitic element 704 and the grounding unit 707.

Figure 8:
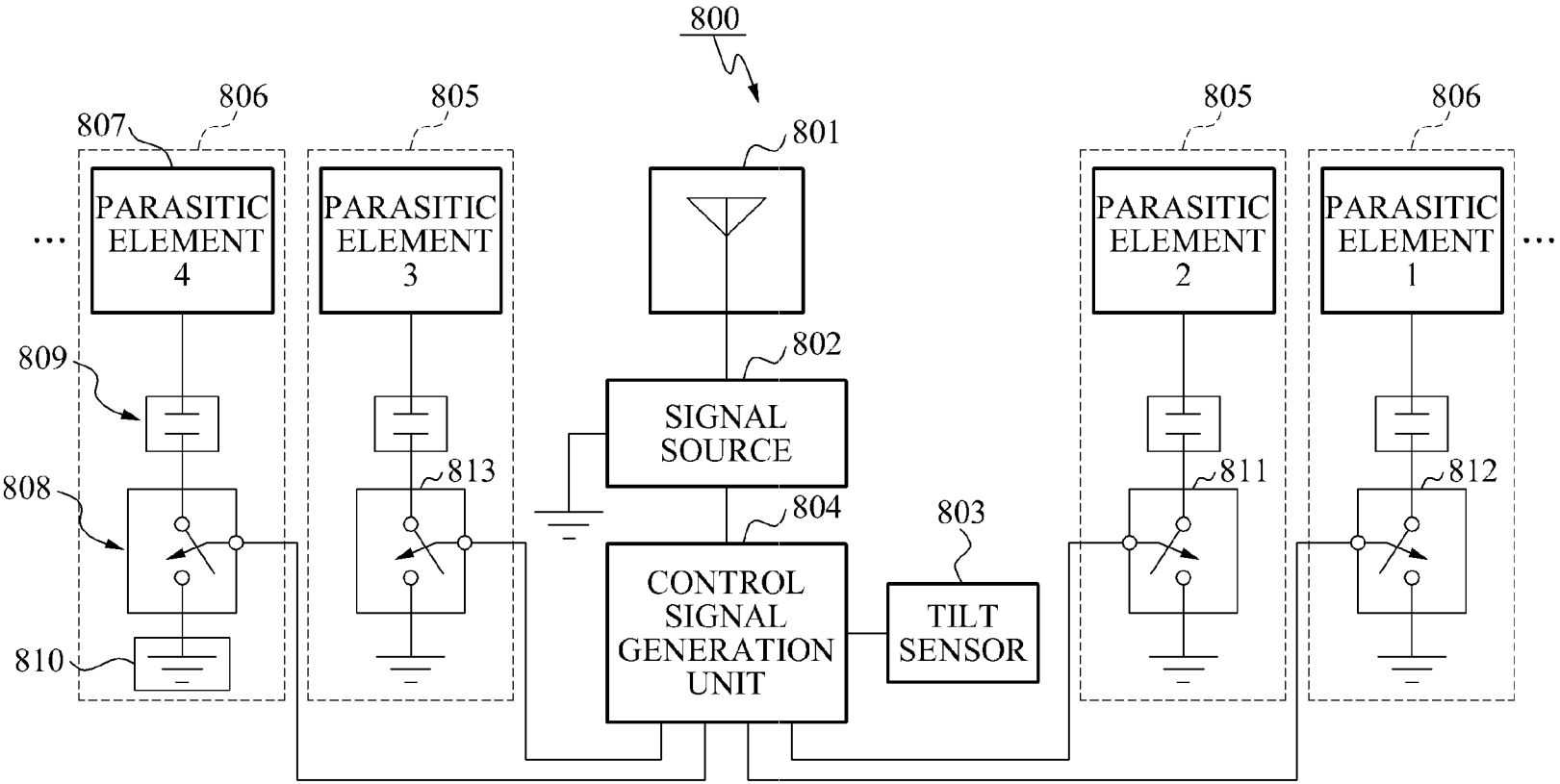
FIG. 8 is a diagram illustrating a horizontal beam adjusting apparatus including pairs of adjusting units, according to an embodiment of the present invention.

FIG. 8 is a diagram illustrating a horizontal beam adjusting apparatus 800 including pairs of adjusting units 805 and 806, according to an embodiment of the present invention.

Referring to FIG. 8, the horizontal beam adjusting apparatus 800 includes a plurality of adjusting units forming pairs with respect to a radiator 801. For example, a pair of first adjusting units 805 and a pair of second adjusting units 806. Here each of the adjusting units may include a parasitic element, a switch, an impedance matching unit, and a grounding unit. For example, a fourth adjusting unit may include a fourth parasitic element 807, a fourth switch 808, a fourth impedance matching unit 809, and a fourth grounding unit 810. Since the adjusting unit operates in the same manner as the adjusting unit of FIG. 7, a detailed description will be omitted.

A control signal generation unit 804 may generate a switch control signal containing a short-circuiting signal or an opening signal with respect to the respective switches, based on the inclination of the omni-directional antenna, calculated by a tilt sensor 803.

For example, when the omni-directional antenna is installed on a leftward inclined surface, the control signal generation unit 804 may determine to short-circuit both or any one of a first switch 811 and a second switch 812, based on the inclination of the omni-directional antenna. When the first switch 811 is determined to be short-circuited, the control signal generation unit 804 may generate the switch control signal containing a short-circuiting signal for the first switch 811, an opening signal for the second switch 812, an opening signal for a third switch 813, and an opening signal for a fourth switch 808. Therefore, coupling between a first parasitic element 814 and the radiator 801 is enhanced, and the radiation direction may be adjusted to be inclined toward the short-circuited first switch 811.

Figure 9:
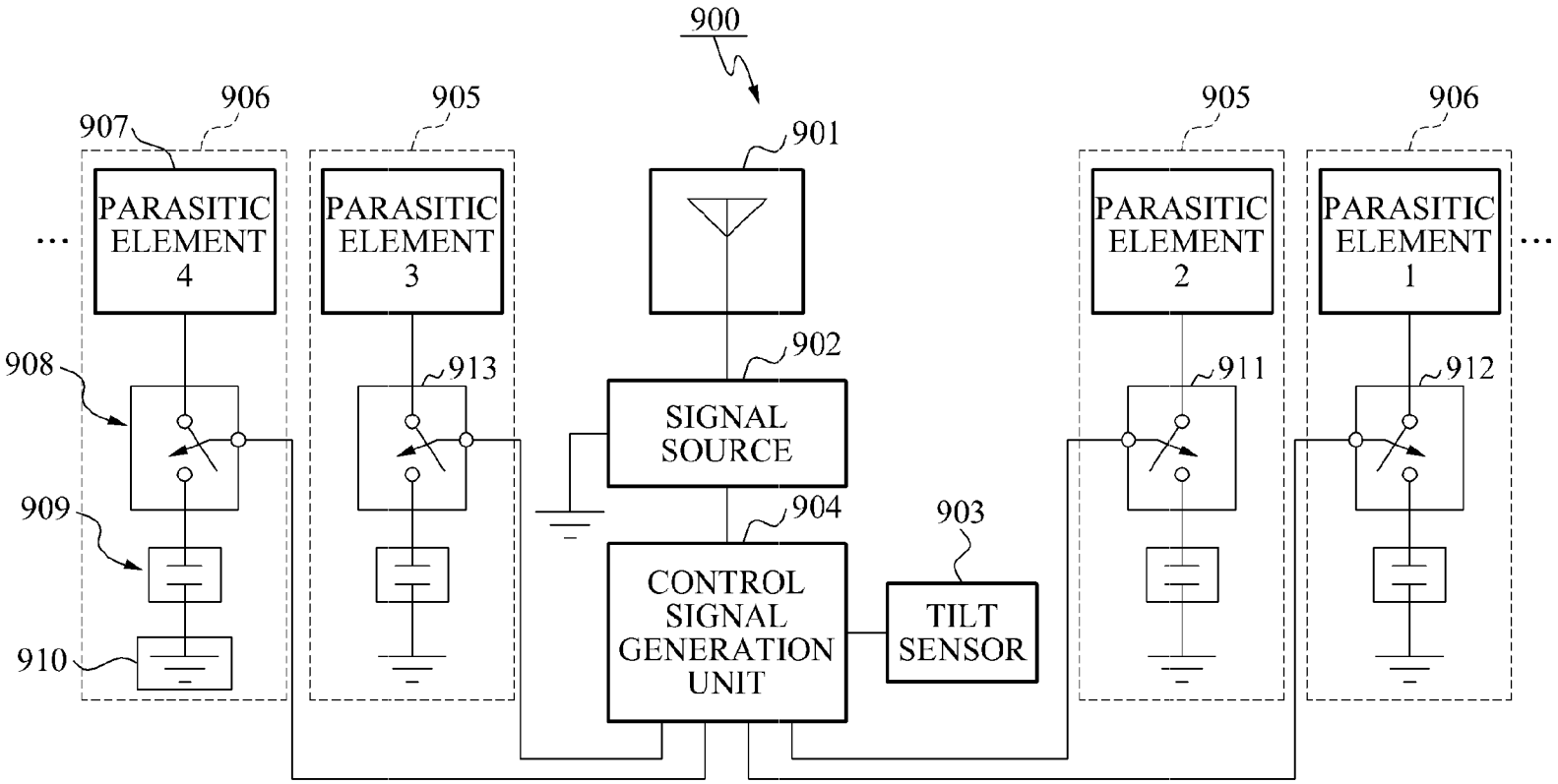
FIG. 9 is a diagram illustrating a horizontal beam adjusting apparatus including pairs of adjusting units, according to another embodiment of the present invention.

FIG. 9 is a diagram illustrating a horizontal beam adjusting apparatus including pairs of adjusting units, according to another embodiment of the present inventions.

In the horizontal beam adjusting apparatus shown in FIG. 9, positions of the switch and the impedance matching unit of the horizontal beam adjusting apparatus of FIG. 8 are exchanged. In the same manner as described with reference to FIG. 8, the switch and the impedance matching unit of FIG. 9 may be disposed between a parasitic element and a grounding unit. Therefore, in the structure having the exchanged positions of the switch and the impedance matching unit of FIG. 8, when the switch is short-circuited, the parasitic element may enhance coupling with a radiator, thereby adjusting a radiation direction of an omni-directional antenna. As a result, the adjusted radiation direction of the omni-directional antenna may be horizontally omni-directional with respect to a ground surface.

Figure 10:
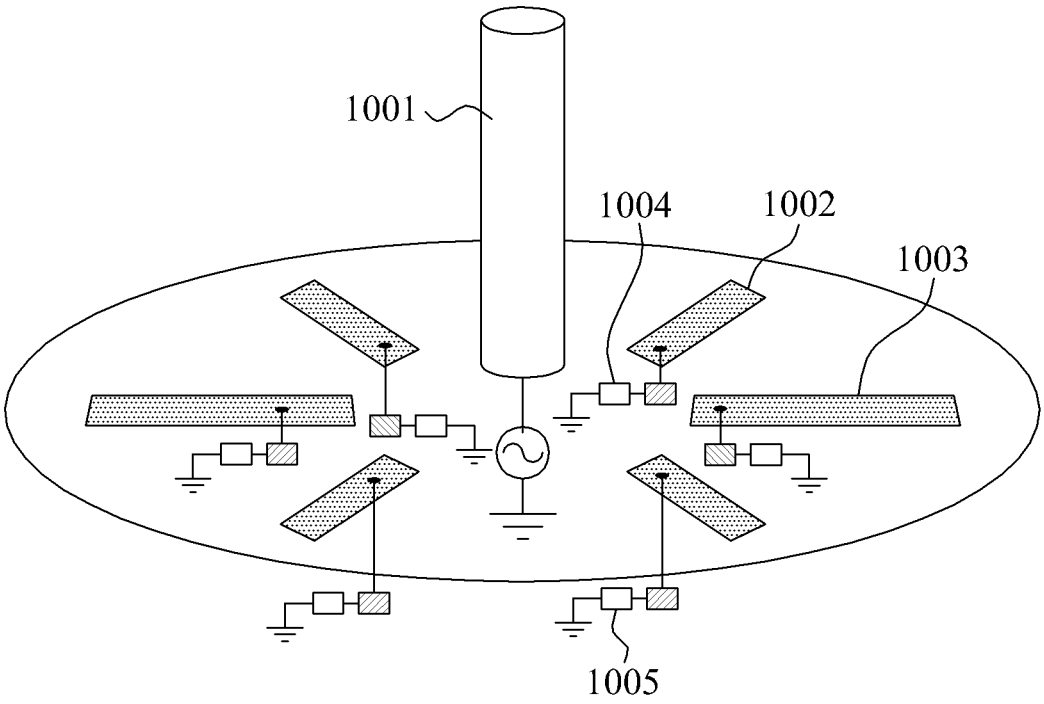
FIG. 10 is a diagram illustrating a structure of the horizontal beam adjusting apparatus, in which parasitic elements are disposed in a circular arrangement, according to an embodiment of the present invention.

FIG. 10 is a diagram illustrating a structure of the horizontal beam adjusting apparatus, in which parasitic elements are disposed in a circular arrangement, according to an embodiment of the present invention.

According to FIG. 10, the parasitic elements are arranged about a radiator 1001. In this case, the horizontal beam adjusting apparatus may determine whether to short-circuit or open respective switches according to an inclination of an omni-directional antenna. When a first switch 1004 and a second switch 1005 are determined to be short-circuited, the horizontal beam adjusting apparatus may short-circuit the first switch 1004 and the second switch 1005, thereby enhancing coupling among a first parasitic element 1002, a second parasitic element 1003, and the radiator 1001. Accordingly, the horizontal beam adjusting apparatus may adjust a radiation direction of the omni-directional antenna to be inclined toward the first switch 1004 and the second switch 1005. That is, the horizontal beam adjusting apparatus may adjust the radiation direction to be inclined to, between the first parasitic element 1002 and the second parasitic element 1003.

A radiation direction adjusting method for an omni-directional antenna based on an inclination of the omni-directional antenna has been described so far. A horizontal beam adjusting apparatus may continuously monitor a tilt sensor and readjust the once-adjusted radiation direction according to an updated value of the inclination.

For example, when the horizontal beam adjusting apparatus attached with the omni-directional antenna is displaced or rearranged, the inclination of the omni-directional antenna may be changed by a changed installation environment. Therefore, the horizontal beam adjusting apparatus may confirm the change of the inclination by monitoring the tilt sensor. According to this, the horizontal beam adjusting apparatus may regenerate a switch control signal based on the changed inclination, and control short-circuiting and opening of the respective switches according to the regenerated switch control signal, thus readjusting the radiation direction of the omni-directional antenna.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A horizontal beam adjusting method comprising:

generating a switch control signal based on an inclination of an antenna; and adjusting a radiation direction of the antenna according to the switch control signal, wherein the adjusting includes:

adjusting the radiation direction of the antenna through a parasitic element;

connecting the parasitic element to a grounding unit according to the switch control signal; and adjusting an impedance value between the parasitic element and the grounding unit.

2. The horizontal beam adjusting method of claim 1, wherein the adjusting of the radiation direction comprises:

short-circuiting or opening at least one switch according to the switch control signal; and adjusting the radiation direction of the antenna to be inclined toward the at least one short-circuited switch.

3. The horizontal beam adjusting method of claim 1, wherein the generating of the switch control signal comprises:

determining whether to short-circuit or open the switch using an inclination of the antenna and a predetermined threshold value; and generating the switch control signal containing at least one of a short-circuiting signal and an opening signal based on the determination.

4. The horizontal beam adjusting method of claim 1, wherein the adjusting of the radiation direction of the antenna adjusts the radiation direction of the antenna using coupling between a radiator and a parasitic element, generated according to the switch control signal.

5. The horizontal beam adjusting method of claim 1, wherein the generating of the switch control comprises:

calculating the inclination of the antenna with reference to a ground surface.

6. The horizontal beam adjusting method of claim 1, wherein the generating of the switch control signal comprises:

obtaining a gravity value of each axis using a tilt sensor; and calculating the inclination of the antenna using the obtained gravity value of each axis.

7. The horizontal beam adjusting method of claim 1, wherein the adjusting of the radiation direction of the antenna adjusts the radiation direction to be inclined toward an inclined surface on which the antenna is installed.

8. The horizontal beam adjusting method of claim 7, wherein the antenna is an omni-directional antenna.

9. A horizontal beam adjusting apparatus comprising:

a control signal generation unit to generate a switch control signal based on an inclination of an antenna; and an adjusting unit to adjust a radiation direction of the antenna according to the switch control signal, wherein the adjusting unit comprises:

a parasitic element to adjust the radiation direction of the antenna;

a switch to connect the parasitic element to a grounding unit according to the switch control signal; and an impedance matching unit to adjust an impedance value between the parasitic element and the grounding unit.

10. The horizontal beam adjusting apparatus of claim 9, wherein the adjusting unit adjusts the radiation direction of the antenna to be inclined to at least one short-circuited switch.

11. The horizontal beam adjusting apparatus of claim 9, wherein the control signal generation unit determines whether to short-circuit or open a switch using an inclination of the antenna and a predetermined threshold value, and generates the switch control signal containing at least one of a short-circuiting signal and an opening signal based on the determination.

12. The horizontal beam adjusting apparatus of claim 9, wherein the adjusting unit adjusts the radiation direction of the antenna using coupling between a radiator and a parasitic element, generated according to the switch control signal.

13. The horizontal beam adjusting apparatus of claim 9, wherein the switch is disposed between the parasitic element and the grounding unit, and the impedance matching unit is disposed between the parasitic element and the grounding unit.

14. The horizontal beam adjusting apparatus of claim 9, wherein the impedance matching unit is disposed between the switch and the grounding unit, and one end of the switch is connected with the impedance matching unit whereas the other end is connected to the parasitic element.

15. The horizontal beam adjusting apparatus of claim 9, wherein the switch is disposed between the impedance matching unit and the grounding unit, and one end of the switch is connected with the impedance matching unit whereas the other end is connected to the grounding unit.

16. The horizontal beam adjusting apparatus of claim 9, further comprising a tilt sensor to calculate an inclination of the antenna with respect to a ground surface.

17. The horizontal beam adjusting apparatus of claim 16, wherein the tilt sensor comprises at least one of an acceleration sensor comprising at least 2 axes, and a gravity sensor comprising at least 2 axes.

18. The horizontal beam adjusting apparatus of claim 9, wherein the adjusting unit adjusts the radiation direction of the antenna to be inclined to an inclined surface on which the antenna is installed.

* * * * *